US007260892B2

(12) United States Patent
Schilling et al.

(10) Patent No.: US 7,260,892 B2
(45) Date of Patent: Aug. 28, 2007

(54) METHODS FOR OPTIMIZING TURBINE ENGINE SHELL RADIAL CLEARANCES

(75) Inventors: Jan Christopher Schilling, Middletown, OH (US); Daniel Edward Mollmann, Cincinnati, OH (US); Barry Lynn Allmon, Maineville, OH (US); Anthony Durchholz, Loveland, OH (US)

(73) Assignee: General Electric Company, Schenectady, NY (US)

( * ) Notice: Subject to any disclaimer, the term of this patent is extended or adjusted under 35 U.S.C. 154(b) by 484 days.

(21) Appl. No.: 10/746,659

(22) Filed: Dec. 24, 2003

(65) Prior Publication Data

US 2005/0138806 A1 Jun. 30, 2005

(51) Int. Cl.
*B21K 25/00* (2006.01)
*B21K 3/04* (2006.01)

(52) U.S. Cl. ..... 29/889.21; 29/889.1; 29/889.2; 29/889.22; 29/434; 415/108; 415/213.1; 415/214.1

(58) Field of Classification Search ..... 29/889.1, 29/889.2, 889.22, 889.21, 464, 468, 469; 415/108, 126, 213.1, 214.1
See application file for complete search history.

(56) References Cited

U.S. PATENT DOCUMENTS 3,936,222 A 2/1976 Asplund et al.
4,053,254 A 10/1977 Chaplin et al.
4,222,708 A * 9/1980 Davison ..... 415/127
4,268,221 A 5/1981 Monsarrat et al.
4,317,646 A 3/1982 Steel et al.
4,439,981 A 4/1984 Weiler et al.
4,439,982 A 4/1984 Weiler et al.
5,017,088 A 5/1991 Miraucourt et al.
5,275,357 A 1/1994 Seelen et al.
5,303,880 A 4/1994 Cencula et al.
5,407,320 A * 4/1995 Hutchinson ..... 415/116
5,575,145 A 11/1996 O'Neill et al.
5,609,471 A 3/1997 Frasier et al.
5,735,046 A 4/1998 Frasier et al.
6,330,995 B1 12/2001 Mangeiga et al.

FOREIGN PATENT DOCUMENTS

WO WO92/11444 * 7/1992

* cited by examiner

*Primary Examiner*—David P. Bryant
*Assistant Examiner*—Sarang Afzali
(74) *Attorney, Agent, or Firm*—William Scott Andes; Armstrong Teasdale LLP

(57) ABSTRACT

A method facilitates the assembly of a stator assembly for a turbine engine. The method includes providing a cantilevered shell including a first end and a second end, and coupling a second member within the turbine engine. The method also includes coupling the shell to a frame such that the shell extends circumferentially around at least a portion of the second member such that a non-uniform circumferential radial gap is defined radially between the second member and the shell using methods other than directing machining of an inner surface of the shell, and wherein the non-uniform circumferential radial clearance gap becomes substantially uniform during operation of the engine.

15 Claims, 4 Drawing Sheets

METHODS FOR OPTIMIZING TURBINE ENGINE SHELL RADIAL CLEARANCES

BACKGROUND OF THE INVENTION

This application relates generally to turbine engines, and more particularly, to structural shells used in axial flow gas turbine engine systems.

Axial flow gas turbine engines typically includes a plurality of second members, such as a fan rotor assembly, a booster assembly, a compressor, and a turbine. The fan rotor assembly includes a fan including an array of fan blades extending radially outward from a rotor shaft. The rotor shaft transfers power and rotary motion from the turbine to the compressor and the fan, and is supported longitudinally with a plurality of bearing assemblies. Bearing assemblies support the rotor shaft and typically include rolling elements located within an inner race and an outer race.

Structural casings extend around the turbomachinery such that radial clearances are defined therebetween. Inadequate clearances defined within the turbine engincs, such as, but not limited to clearances between rotating seals and stationary members, between bearing elements and bearing races, between a bearing race and a damper housing, and/or between rotor blades and surrounding casing, may adversely affect performance of the associated turbomachinery. Howevcr, maintaining control of such clearances may be difficult during engine operation as the second members may expcrience distortions which may alter the clearances defined betwcen the casings and second member. For example, in the case of a fan assembly, axial thrust generated by an engine may be reacted by a thrust links coupled between the fan assembly and the engine frame. The thrust links may cause the frame to ovalize into a lobed pattern, that may not attenuate through the engine structure, but rather may be propagated into the attaching structures forward and aft of the fan frame.

To facilitate maintaining substantially constant clearances during engine operation, at least some known high pressure compressor casings and bearing housings, such as are utilized on the GE 90-115 engine, have accommodated such thrust loading deflections by directly offset grinding the case or critical bores to an out-of-round condition (known as a pre-lobed condition) during assembly. The distortion due to thrust load essentially cancels the oval manufacturing shape, and causes the case bore to assume a substantially round condition at a pre-determined operating thrust point such that respective rotor-to-stator, and/or bearing, clearances are facilitated to be radially maintained. However, direct machining such components may be a time consuming process that may be repeated several times until the critical bore shape is obtained.

BRIEF DESCRIPTION OF THE INVENTION

In one aspect, a method for assembling a stator assembly for a turbine engine. The method includes providing a cantilevered shell including a first end and a second end, coupling a second member within the turbine engine, and coupling the shell to a frame such that the shell extends circumferentially around at least a portion of the second member such that a non-uniform circumferential radial clearance gap is defined radially between the second member and the cantilevered shell without directing machining of an inner surface of the shell, and wherein during assembly the circumferential radial clearance gap remains substantially non-uniform.

In another aspect, a method for assembling a gas turbine engine is provided. The method includes coupling a second member within the gas turbine engine, and coupling a cantilevered shell having a first end and a second end to a frame within the engine such that the shell extends circumferentially around second member such that a non-uniform circumferential radial clearance gap is defined between the second member and the shell without direct machining, and wherein the circumferential radial gap remains non-uniform during assembly.

DETAILED DESCRIPTION OF THE INVENTION

Figure 1:
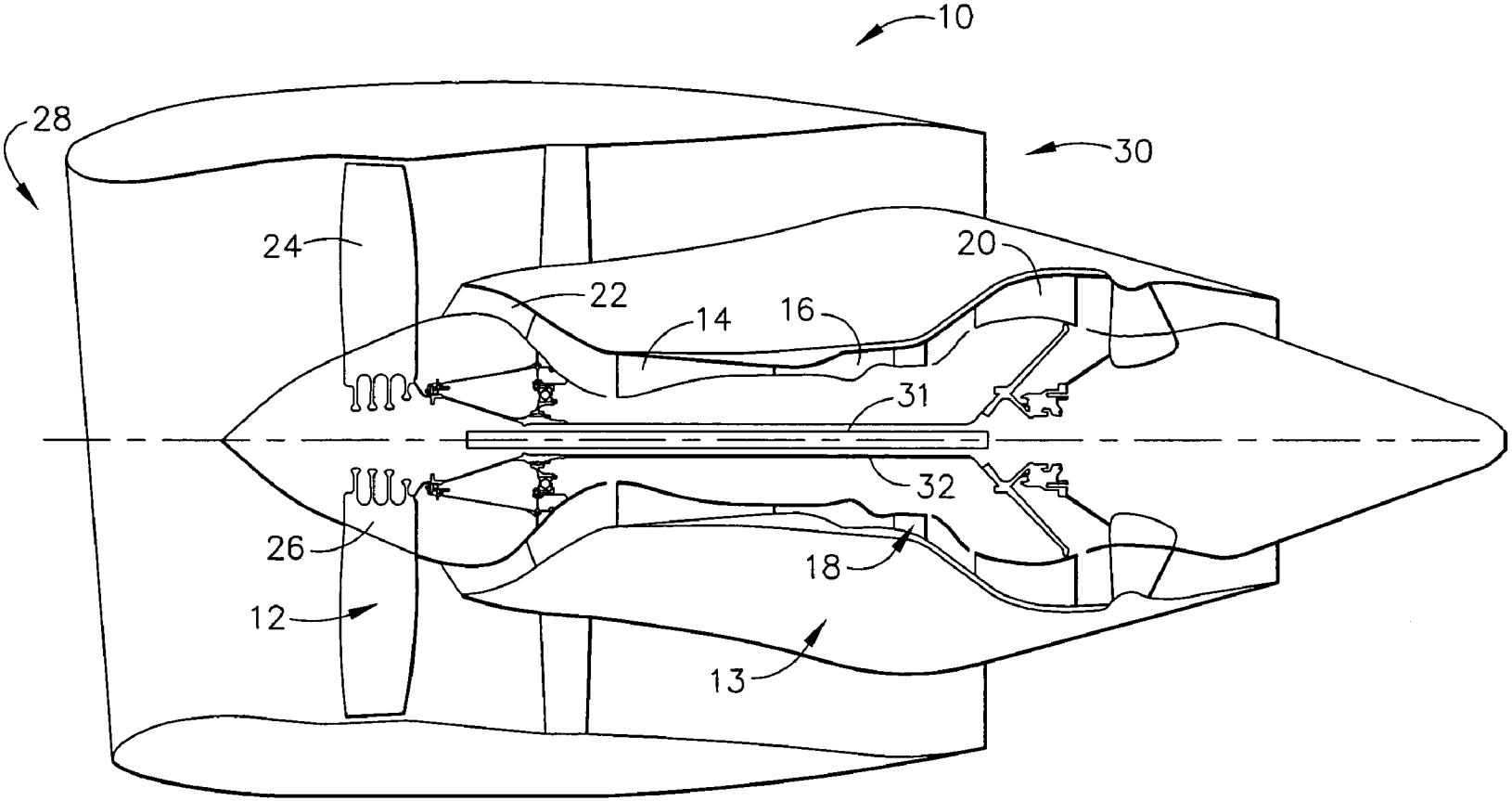
FIG. 1 is schematic illustration of a gas turbine engine.

FIG. 1 is a schematic illustration of a gas turbine engine 10 including a fan assembly 12 and a core engine 13 including a high pressure compressor 14, and a combustor 16. Engine 10 also includes a high pressure turbine 18, a low pressure turbine 20, and a booster 22. Fan assembly 12 includes an array of fan blades 24 extending radially outward from a rotor disc 26. Engine 10 has an intake side 28 and an exhaust side 30. In one embodiment, the gas turbine engine is a GE90 available from General Electric Company, Cincinnati, Ohio. Fan assembly 12 and turbine 20 are coupled by a first rotor shaft 31, and compressor 14 and turbine 18 are coupled by a second rotor shaft 32.

During operation, air flows axially through fan assembly 12, in a direction that is substantially parallel to a central axis 34 extending through engine 10, and compressed air is supplied to high pressure compressor 14. The highly compressed air is delivered to combustor 16. Airflow (not shown in FIG. 1) from combustor 16 drives turbines 18 and 20, and turbine 20 drives fan assembly 12 by way of shaft 31.

Figure 2:
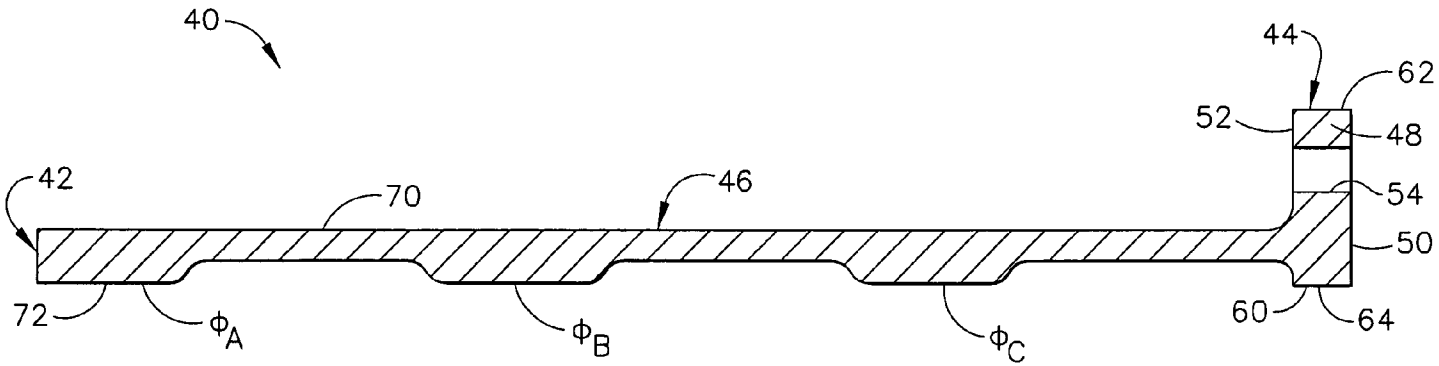
FIG. 2 is an exemplary schematic illustration of a cantilevered shell that may be used within the engine shown in FIG. 1.

FIG. 2 is an exemplary schematic illustration of an annular cantilevered shell 40 that may be used within engine 10. Shell 40 includes an unsupported end 42, a coupling end 44, and an integral body 46 extending therebetween. Coupling end 44 includes a flange 48 that extends radially from body 46. More specifically, in the exemplary embodiment, flange 48 extends substantially perpendicularly from body 46, and includes a flange face 50, a coupling face 52, and a plurality of circumferentially-spaced openings 54 extending therebetween. Openings 54 are each sized to receive a fastener (not shown in FIG. 2) therethrough for coupling shell 40 to a structural support (not shown in FIG. 2).

Flange 48 extends radially between an inner surface 60 and a radially outer edge 62. In the exemplary embodiment, flange inner surface 60 is formed integrally with a flange rabbet or radial positioner 64 that facilitates aligning shell 40 and flange 48 with respect to the structural support. In an alternative embodiment, flange radially edge 62 is formed with a flange rabbet 64.

Body 46 includes an outer surface 70 and an opposite inner surface 72. Inner surface 72 is formed with a plurality of axial planes $\Phi_A$, $\Phi_B$, and $\Phi^C$ that each at least partially define a shell radial clearance when shell 40 is coupled within engine 10 and around a second member. In one embodiment, the second member is a component within a rotor assembly. In another embodiment, the second member is a component within a stationary structure.

Figure 6:
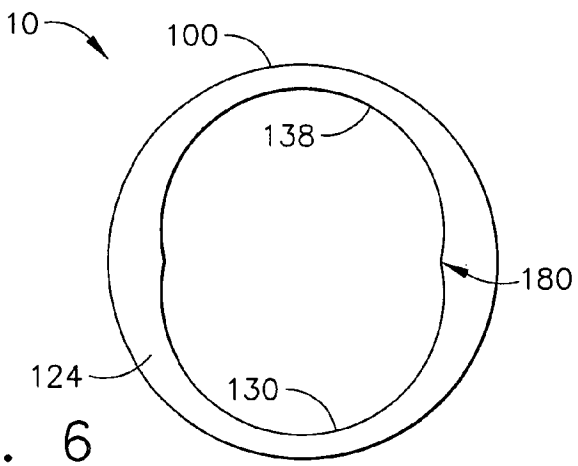
FIG. 6 is a front end view of the shell shown in FIG. 3.
Figure 3:
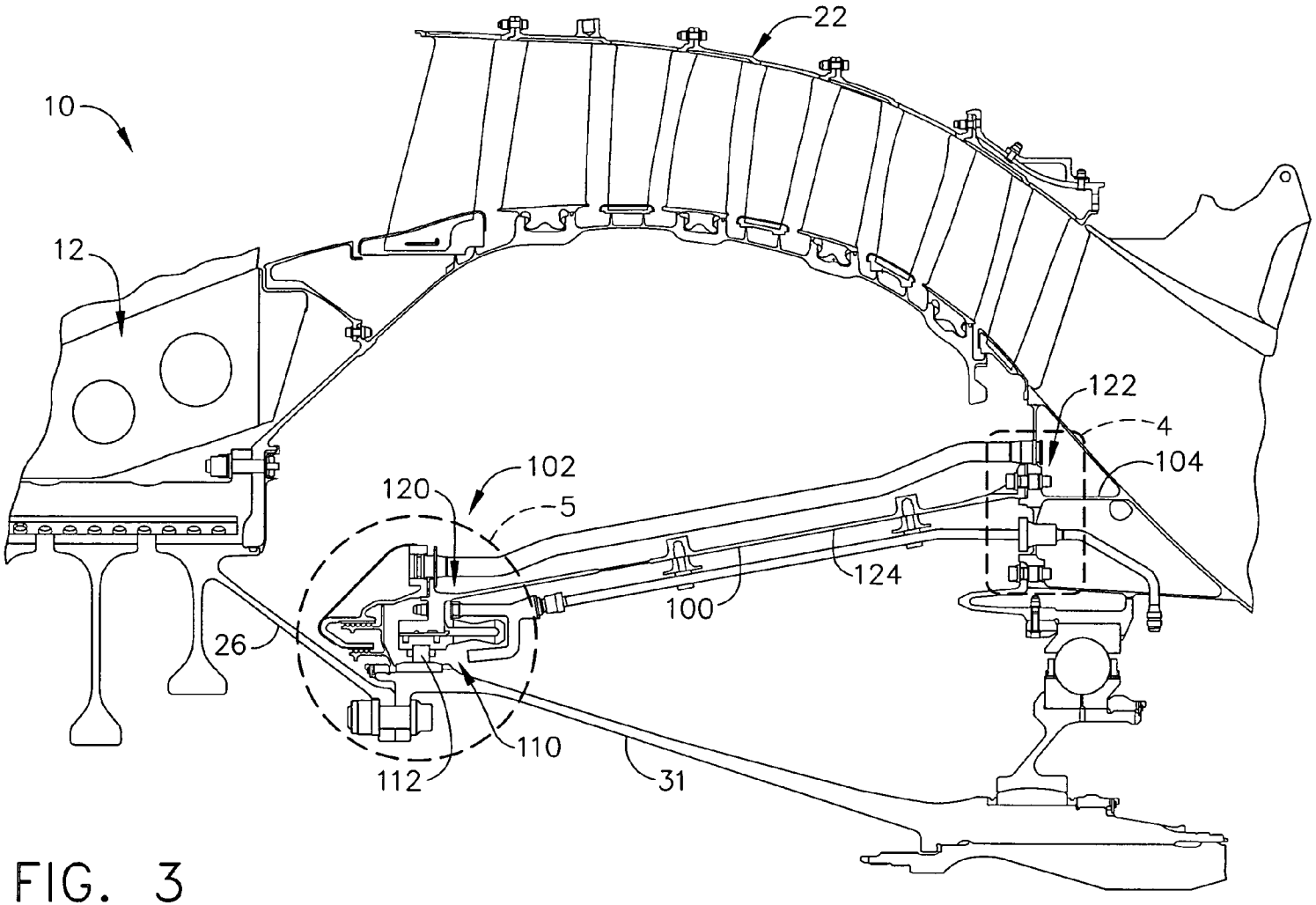
FIG. 3 is a cross-sectional view of a portion of the gas turbine engine shown in FIG. 1 and including at least one shell.
Figure 4:
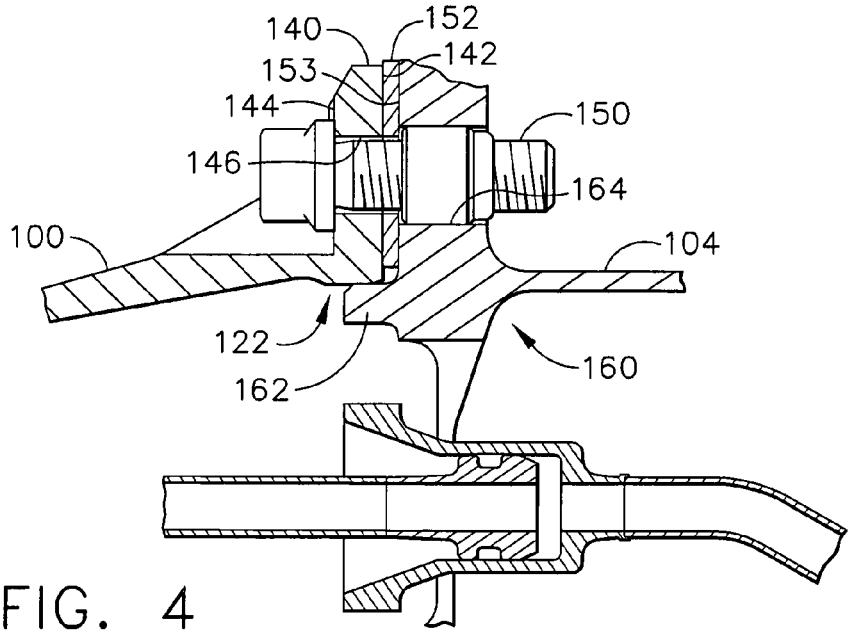
FIG. 4 is an enlarged view of a portion of the gas turbine engine shown in FIG. 3 and taken along area 4.
Figure 5:
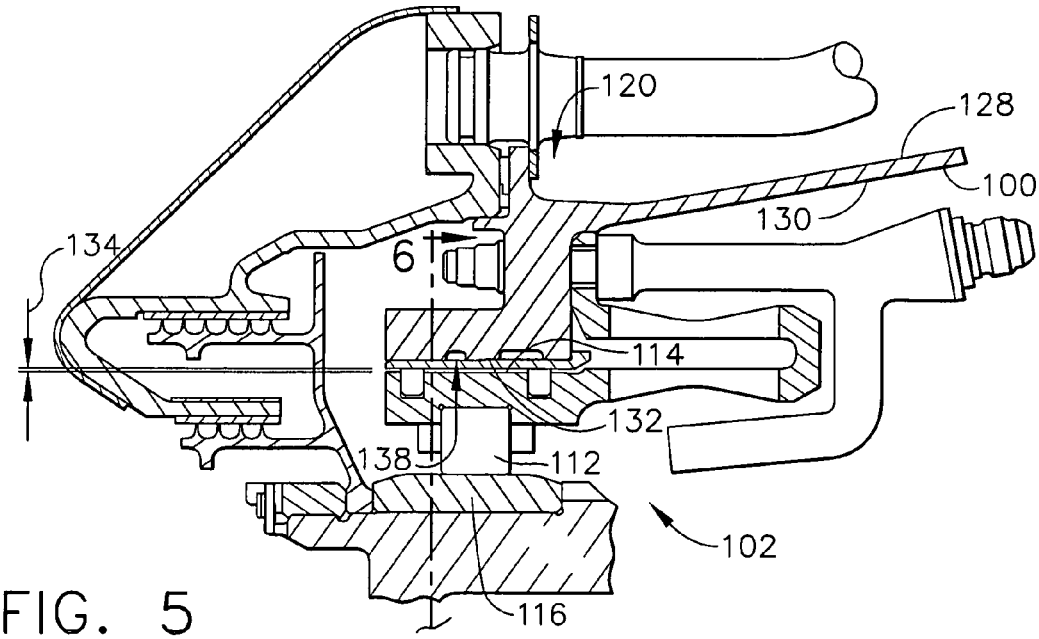
FIG. 5 is an enlarged view of a portion of a bearing assembly shown in FIG. 3 and taken along area 5.

FIG. 3 is a cross-sectional view of a portion of gas turbine engine 10 including a cantilevered shell 100, booster shell 101, and fan rotor assembly 12. FIG. 4 is an enlarged view of a portion of gas turbine engine 10 taken along area 4. FIG. 5 is an enlarged view of a portion of a bearing assembly 102 used with engine 10 taken along area 5. FIG. 6 is a front end view of shell 100.

As used herein, the term "shell" may include any structural component having a significant length and diameter in comparison to its thickness. For example, the shell may be, but is not limited to being a bearing housing, a booster casing, an outer booster shell, a stationary seal support, or any structural component functioning as described herein and coupled within engine 10 such that a desired radial clearance is defined between the shell and a second member. A bearing housing is intended as exemplary only, and thus is not intended to limit in any way the definition and/or meaning of the term "shell". Furthermore, although the invention is described herein in association with a gas turbine engine, and more specifically for use with a bearing assembly for a gas turbine engine, it should be understood that the present invention is applicable to other gas turbine engine components, as well as other turbine engines. Accordingly, practice of the present invention is not limited to bearing housings for gas turbine engines.

Rotor shaft 31 is rotatably coupled to fan rotor disc 26 and is secured to a structural frame 104 by a plurality of bearing assemblies 102 that support rotor shaft 31. In the exemplary embodiment, bearing assembly 102 includes a paired race 110 and a rolling element 112, that are each positioned within a bearing housing bore 138 defined by frame 104.

Bearing housing or shell 100 includes an upstream end 120, a downstream end 122, and a shell body 124 extending therebetween. Shell body 124 includes an outer surface 128 and an opposite inner surface 130. Inner surface 130 at least partially defines a shell radial clearance 134 when shell 100 is coupled within engine 10. Specifically, when shell 100 is coupled within engine 10, radial clearance 134 is defined circumferentially between shell inner surface 130 and bearing outer race 114 of bearing assembly 102 within bearing housing bore 138.

Shell downstream end 122 includes a flange 140 that extends radially outward from body 124. More specifically, in the exemplary embodiment, flange 140 extends substantially perpendicularly from body 124, and includes a flange face 142, a coupling face 144, and a plurality of circumferentially-spaced openings 146 extending therebetween. Openings 146 are each sized to receive a fastener 150 therethrough for coupling shell 100 to fan support frame 104. More specifically, in the exemplary embodiment, when shell 100 is coupled to fan support frame 104, a gasket 152 extends between flange face 142 and frame 104.

Shell 100 is coupled to frame 104 at shell downstream end 122 within a flange joint 160 by fasteners 150. In the exemplary embodiment, flange joint 160 includes a rabbet 162 which facilitates radially locating shell 100 with respect to fan frame 104 such that shell 100 is substantially concentrically aligned with respect to frame 104. Openings 164 are circumferentially spaced and are sized to receive fasteners 150 therethrough. In one embodiment, rabbet 162 is contoured to mate against a flange rabbet, such as rabbet 64 (shown in FIG. 2) to facilitate aligning shell 100 with respect to frame 104.

After bearing housing or shell 100 is coupled to fan frame 104 such that a pre-lobed bore shape that is non-circular, such as the bi-lobed radial shape 180 shown in FIG. 6, also known as an "out-of-round condition," is induced to shell body 124 within bore 138. In alternative embodiments, other pre-lobed shapes, such as tri-lobed bore shapes, may be induced to shell body 124 within bore 138. Accordingly, during assembly, when bearing housing or shell 100 is secured to fan frame 104, a non-uniform circumferential radial clearance is defined between shell body 124 and bearing outer race 114. In contrast, during operation of engine 10, as described in more detail below, the circumferential radial clearance becomes substantially uniform. In the exemplary embodiment, the non-uniform circumferential radial clearance is induced across substantially the entire axial length of shell body 124 within bore 138. In alternative embodiments, the circumferential radial clearance varies at different axial locations across shell body 124 within bore 138.

The pre-lobed shape 180, and/or the different radial clearances defined, are not formed as a result of direct machining of shell inner housing surface 130, but rather, as described in more detail below, are created without direct machining of inner surface 130 within bore 138. In one embodiment, frame alignment rabbet 162 is machined into a desired pre-lobed radial shape such that when shell 100 is coupled to fan frame 104, the desired non-uniform circumferential radial clearance defined between shell body 124 and bearing outer race 114 is induced during assembly. In another embodiment, a flange rabbet, such as rabbet 64 and/or a rabbet formed against a flange radially outer edge, is machined into a desired pre-lobed radial shape such that when shell 100 is coupled to fan frame 104, the interface between the non-circular flange rabbet and fan frame 104 induces a circumferential radial clearance between shell body 124 and bearing outer race 114 that remains non-uniform during assembly.

In a further embodiment, flange face 142 is machined such that face 142 is no longer substantially perpendicular to shell body 124, but rather is formed substantially non-planar, axially across flange face 142. Accordingly, when flange face 142 is coupled against fan frame 104 with fasteners 150, the torqued fasteners force shell 100 substantially flat against fan frame 104, such that a deformed shape is transmitted through shell body 124 and such that a circumferential radial clearance induced between shell body 124 and bearing outer race 114 remains non-uniform during assembly of engine 10.

In yet a further alternative embodiment, a flange face 153 defined on flange joint 160 is machined such that face 153 is no longer substantially perpendicular to shell body 124, but rather is formed substantially non-planar, axially across flange face 153. Accordingly, when flange face 153 is coupled against shell body 124 with fasteners 150, the torqued fasteners force shell 100 substantially flat against fan frame 104, such that a deformed shape is transmitted through shell body 124 and such that a circumferential radial clearance induced between shell body 124 and bearing outer race 114 remains non-uniform during assembly of engine 10.

Similarly, in yet another embodiment, although flange face 142 remains substantially perpendicular to shell body 124, a gasket, such as gasket 152, having a variable thickness extending axially across the gasket is inserted between flange face 142 and mating flange joint 160. Accordingly, when flange face 142 is coupled against fan frame 104 through gasket 152 with fasteners 150, the torqued fasteners force shell 100 against gasket 152, such that a deformed shape is transmitted through shell body 124 such that a non-uniform circumferential radial clearance is induced between shell body 124 and bearing outer race 114 during assembly of engine 10.

In yet another embodiment, shell 100 is fabricated using a known machining restraint fixture that has been modified. More specifically, at least some known machining restraint fixtures used in fabricating shells 100 are configured to substantially mate with frame alignment rabbet 162. Such machining restraint fixtures are modified such that the portion of the fixture that mates with the rabbet is deformed to a desired pre-lobed shape prior to the shell being coupled to the fixture for fabrication. Shell 100 is then machined such that inner surface 132 is defined as substantially circular adjacent end 120 and shell body 124. Accordingly, when shell 100 is removed from the machining restraint fixture, the interface between shell 100 and the substantially circular frame alignment rabbet 162 induces the desired non-uniform circumferential radial clearance between shell body 124 and bearing outer race 114 during assembly.

It should be noted that the desired non-uniform circumferential radial clearance is not limited to being fabricated using only the fabrication techniques described herein, but rather other methods of accomplishing the pre-lobed shell bore shape at assembly may be used in which the critical bore 138 is not direct machined. It should also be noted that the fabrication techniques described herein are not limited to bearing housing shells 100, and that rather the fabrication techniques are described as exemplary only with respect to shell 100.

During operation of engine 10, distortions within engine 10 that may alter radial clearances 134 are substantially accommodated by shell 100. More specifically, although the second clearance remains non-uniform during assembly and non-operation of engine 10, during operation, at a predetermined engine operating condition, the shell pre-lobed shape compensates for the thrust deflections induced by engine 10 and deflects to be substantially round within housing bore 138. Accordingly, during such engine operations, a substantially uniform radial clearance is induced between shell body 124 and bearing outer race 114.

In the exemplary embodiment, the deflection of the shell pre-lobed shape facilitates providing a constant volume damper bearing oil film around the circumference of bearing outer race 114, between outer race 114 and shell 100, such that damper performance and the bearing useful life are each facilitated to be increased. In other embodiments, wherein shell 100 is a booster casing and/or a compressor casing, the deflection of shell 100 facilitates minimizing blade to case flowpath clearance and/or rubs and as such, also facilitates improving performance of the associated booster and/or compressor. In additional embodiments, depending on the application of shell 100, the deflection of shell 100 may facilitate minimizing vane to rotor seal clearance and rubs, and therefore facilitate improving overall engine performance. Alternatively, and depending on the application of shell 100, the deflection of shell 100 may facilitate providing a substantially round bearing housing, which contains an interference fitted (no radial clearance) outer race to housing bore. Within such an embodiment, the bearing outer race remains substantially round at a specific operating point, thus facilitating increasing bearing useful life.

The above-described shells are cost-effective and highly reliable. Each shell is coupled to a structural frame such that a pre-lobed shape induced within the shell creates a clearance gap that remains non-uniform at a specific axial location during non-operational periods of engine. More specifically, the shell inner surface is not directly machined to form the non-uniform circumferential radial gap, but rather, a pre-lobed shell bore shape is created at assembly by inducing the pre-lobed shape to the shell remote from the critical bore being monitored. During engine operation, the shell may be distorted in response to thrust deflections, thermal deflections, and/or other imposed deflections from the engine or aircraft operation, resulting in optimizing the clearance gap during engine operation. As a result, the pre-lobed shape facilitates extending a useful life and performance of the structural assembly when the engine is operating.

Exemplary embodiments of a shell and methods of inducing a pre-lobed shape to the shell, such that a non-uniform circumferential radial clearance is defined, are described above in detail. The shells illustrated are not limited to the specific embodiments described herein, but rather, the shell may be utilized independently and separately from the gas turbine engine components described herein. For example, the shell may also be used in combination with other turbine engine systems.

While the invention has been described in terms of various specific embodiments, those skilled in the art will recognize that the invention can be practiced with modification within the spirit and scope of the claims.

What is claimed is:

1. A method for assembling a stator assembly for a turbine engine, said method comprising:

providing a cantilevered shell including a first end and a second end;

coupling a second member within the turbine engine;

coupling the shell to a frame such that the shell extends circumferentially around at least a portion of the second member such that a non-uniform circumferential radial clearance gap is defined radially between the second member and the cantilevered shell without direct machining of an inner surface of the shell, and wherein the circumferential radial clearance gap remains substantially non-uniform when the engine is not operating; and coupling the shell to the frame such that during a predetermined rotor operation the non-uniform radial clearance gap becomes substantially uniform circumferentially between the shell and the second member.

2. A method in accordance with claim 1 wherein at least one end of the cantilevered shell includes a rabbet used to facilitate aligning the shell with respect to the engine frame, said coupling the shell to a frame such that the shell extends circumferentially around at least a portion of the second member further comprises forming the shell rabbet such that a substantially non-circular mating surface is defined by the rabbet.

3. A method in accordance with claim 2 wherein forming the shell rabbet such that a substantially non-circular mating surface is defined by the rabbet further comprises forming the mating surface of the rabbet with a radial pre-lobed shape.

4. A method in accordance with claim 2 wherein forming the shell rabbet such that a substantially non-circular mating surface is defined by the rabbet further comprises forming the mating surface of the rabbet with a non-planar shape.

5. A method in accordance with claim 1 wherein said coupling the shell to a frame such that the shell extends circumferentially around at least a portion of the second member further comprises machining a flange face defined on the engine frame such that the non-uniform circumferential radial clearance is induced when the shell is coupled against the engine frame flange face.

6. A method in accordance with claim 1 wherein the engine frame includes a rabbet used to facilitate aligning the shell with respect to the engine frame, said coupling the shell to a frame such that the shell extends circumferentially around at least a portion of the second member further comprises machining the frame rabbet such that a substantially non-circular mating surface is defined by the frame rabbet.

7. A method in accordance with claim 1 wherein at least one of the shell first end and the shell second end includes a flange face, said coupling the shell to a frame such that the shell extends circumferentially around at least a portion of the second member further comprises machining the flange face such that the non-uniform circumferential radial clearance is induced when the shell is coupled to the engine frame.

8. A method in accordance with claim 1 wherein said coupling the shell to a frame such that the shell extends circumferentially around at least a portion of the second member further comprises coupling the shell to the engine frame to facilitate minimizing radial clearance between the shell and the second member during engine operation.

9. A method for assembling a gas turbine engine, said method comprising:

coupling a second member within the gas turbine engine; and coupling a cantilevered shell having a first end and a second end to a frame within the engine such that the shell extends circumferentially around second member such that, at a given axial location of the shell, a non-uniform circumferential radial clearance gap is defined between the second member and the shell without direct machining, and wherein the circumferential radial gap remains non-uniform during assembly, the cantilevered shell coupled such that during predetermined engine operations, the shell compensates for thrust deflections and assumes a shape that causes the circumferential radial clearance gap to become substantially uniform.

10. A method in accordance with claim 9 wherein the engine includes a compressor, at least one bearing, a rotating seal, and booster, said coupling a cantilevered shell having a first end and a second end further comprises coupling the shell around at least one of the compressor, the bearing, the rotating seal, and the booster.

11. A method in accordance with claim 9 further comprising forming at least one of the shell and the engine frame with a radial pre-lobed shape that induces the non-uniform circumferential radial clearance gap during assembly of the turbine engine.

12. A method in accordance with claim 9 further comprising forming at least one of the shell and the engine frame with a non-planar shape that induces the non-uniform circumferential radial clearance gap to be defined during assembly of the turbine engine.

13. A method in accordance with claim 9 wherein at least one end of the shell is formed with a flange face, said coupling a cantilevered shell having a first end and a second end further comprises machining the flange face to facilitate inducing the non-uniform circumferential radial gap when the shell is coupled to the engine frame.

14. A method in accordance with claim 9 wherein coupling a cantilevered shell having a first end and a second end further comprises coupling the shell to the engine frame to facilitate reducing contact between the shell and the second member during engine operation.

15. A method in accordance with claim 9 wherein coupling a cantilevered shell having a first end and a second end further comprises coupling the shell to the engine frame to facilitate extending a useful life of the second member.

* * * * *